US006594591B2

(12) United States Patent
Clark et al.

(10) Patent No.: US 6,594,591 B2
(45) Date of Patent: Jul. 15, 2003

(54) METHOD AND SYSTEM FOR PROCESSING RAIL INSPECTION TEST DATA

(75) Inventors: Robin Clark, New Fairfield, CT (US); Jeffery L. Boyle, Brookfield, CT (US); Brewster W. LaMacchia, Andover, MA (US)

(73) Assignee: Sperry Rail, Inc., Danbury, CT (US)

( * ) Notice: Subject to any disclaimer, the term of this patent is extended or adjusted under 35 U.S.C. 154(b) by 0 days.

(21) Appl. No.: 10/043,494

(22) Filed: Jan. 11, 2002

(65) Prior Publication Data

US 2002/0099507 A1 Jul. 25, 2002

Related U.S. Application Data

(63) Continuation-in-part of application No. 09/973,903, filed on Oct. 10, 2001.

(60) Provisional application No. 60/238,966, filed on Oct. 10, 2000.

(51) Int. Cl.[7] ..... G01N 29/06; G01M 19/00; G06F 19/00

(52) U.S. Cl. ..... 702/35; 324/217; 702/36; 702/182; 702/184; 702/39

(58) Field of Search ..... 702/33, 35, 36, 702/39, 182, 184; 73/602, 632, 636; 324/217, 220; 714/220; 703/7

(56) References Cited

U.S. PATENT DOCUMENTS

| | | | | |
|---|---|---|---|---|
| 2,900,596 | A | 8/1959 | Drake | 324/217 |
| 2,925,552 | A | 2/1960 | Cowan et al. | 324/217 |
| 3,593,122 | A | 7/1971 | Barton et al. | 324/220 |
| 4,310,796 | A | 1/1982 | Braithwaite et al. | 324/220 |
| 4,429,576 | A | 2/1984 | Norris | 73/638 |
| 4,447,777 | A | 5/1984 | Sharp et al. | 324/220 |
| 4,560,931 | A | 12/1985 | Murakami et al. | 324/220 |
| 5,386,727 | A | 2/1995 | Searle | 73/602 |
| 5,777,891 | A | 7/1998 | Pagano et al. | 702/39 |
| 5,867,404 | A | 2/1999 | Bryan | 714/724 |
| 5,970,438 | A | 10/1999 | Clark et al. | 702/184 |
| 6,055,862 | A | 5/2000 | Martens | 73/632 |
| 6,064,428 | A | 5/2000 | Trosino et al. | 348/128 |
| 6,104,970 | A | 8/2000 | Schmidt, Jr. et al. | 701/2 |

OTHER PUBLICATIONS

Veitch et al.; "System and method for simulating railroad rail testing"; Pub. No.: US 2002/0183995 A1; Filed Date: Jun. 5, 2001.*

* cited by examiner

*Primary Examiner*—Michael Nghiem
*Assistant Examiner*—John Le
(74) *Attorney, Agent, or Firm*—Hunton & Williams

(57) ABSTRACT

A data processing system is provided for use in conjunction with a rail inspection system having a detection carriage with a plurality of sensor units configured to sense discontinuities in a rail of a railroad track as the detector carriage travels along the railroad track. The system includes a data processing and recording computer connectable to the plurality of sensor units for receiving sensor data therefrom. At least one processor card may be included in the data processing and recording computer that includes at least one data object builder configured for building data objects using the sensor data from the plurality of sensor units. The at least one processor card may also include device for synchronizing the data objects with respect to location along the rail. The system may further include a defect detection module in the data processing and recording computer. The defect detection module is in communication with the at least one data object builder and is configured for using the data objects to determine rail locations having suspected defects.

29 Claims, 9 Drawing Sheets

METHOD AND SYSTEM FOR PROCESSING RAIL INSPECTION TEST DATA

This application is a continuation-in-part of U.S. patent application Ser. No. 09/973,903 filed Oct. 10, 2001, which claims the benefit of Provisional Application No. 60/238,966 filed on Oct. 10, 2000, which is incorporated herein by reference in its entirety.

BACKGROUND OF THE INVENTION

The present invention relates generally to rail inspection data processing systems and methods and, more particularly, to a rail inspection data processing system for processing and integrating data from both a magnetic induction sensor system and an ultrasonic sensor system.

Railroad rail inspection typically involves the use of magnetic induction sensors, ultrasonic sensors or both magnetic induction and ultrasonic sensors. Use of magnetic induction sensing involves the injection of a large direct current into the rail using two sets of contacts or brushes. Discontinuities in the railhead section cause a disturbance of the current flowing through the railhead between the contacts. The discontinuity is detected using a sensing head that responds to the accompanying magnetic field disturbance. Perturbations in the magnetic field around the railhead are detected as induced voltages in search coils in the sensing head. The induced voltages produce signal currents that may be processed and/or displayed to an operator.

Ultrasonic techniques typically use ultrasonic transducers mounted in pliable wheels that ride over the upper surface of the rail. These wheels are filled with a coupling fluid so that the transducers mounted inside can send ultrasonic signals into the rail. The return signals are processed and used to map the locations of flaws in the rail.

Not all rail defects are detectable by either the magnetic induction technique or the ultrasonic technique. Using a combination of the two methods greatly reduces the number of "false calls" (i.e., indications of a defect where such an indication is actually unwarranted). It is therefore desirable to conduct defect testing using both magnetic induction and ultrasonic techniques as complementary methods.

Combined usage of the two inspection techniques has generally been limited to separate identification of defects by the two systems. While processed data from both sensor systems may be displayed side-by-side to allow an operator to view results from both systems simultaneously, the data have not been integrated for use in a combined defect evaluation.

SUMMARY OF THE INVENTION

The present invention provides a data processing system that processes and integrates magnetic induction sensor data and ultrasonic sensor data and produces a combined inspection system defect file.

An illustrative aspect of the invention provides a data processing system for use in conjunction with a rail inspection system having a detection carriage with a plurality of sensor units configured to sense discontinuities in a rail of a railroad track as the detector carriage travels along the railroad track. The system comprises a data processing and recording computer connectable to the plurality of sensor units for receiving sensor data therefrom. At least one processor card may be included in the data processing and recording computer that includes at least one data object builder configured for building data objects using the sensor data from the plurality of sensor units. The at least one processor card may also include means for synchronizing the data objects with respect to location along the rail. The system may further comprise a defect detection module in the data processing and recording computer. The defect detection module is in communication with the at least one data object builder and is configured for using the data objects to determine rail locations having suspected defects.

Another aspect of the invention provides a method of identifying suspected rail defect locations that may be used in a rail inspection system having a data processing system in communication with a plurality of sensor units attached to a rail-traveling carriage. The sensor units are configured to sense discontinuities in a rail of a railroad track as the detector carriage travels along the railroad track. The method comprises propelling the detector carriage along the railroad track and generating periodic synchronization pulses as a function of distance from a fixed reference point on the track. Each synchronization pulse is assigned a synchronization pulse number. The method further comprises obtaining sensor data for a plurality of rail locations, each rail location having an associated synchronization pulse number. The sensor data are received at the data processing system. The method further comprises sampling the sensor data to create sensor data sets, each sensor data set including sensor data from one of the plurality of sensor units taken at one of the plurality of rail locations. The method still further comprises determining for each sensor data set whether the sensor data meets predetermined suspected defect criteria. Groups of spatially sequential data sets meeting the predetermined suspected defect criteria are then identified. Each group includes sensor data from only one of the plurality of sensor units. The data sets of each group collectively meet a set of predetermined object creation criteria. A data object is created from each group of spatially sequential data sets meeting the set of predetermined object creation criteria. The data object includes the synchronization pulse number associated with a selected one of the group of spatially sequential data sets. The method also comprises identifying suspected rail defects by applying defect detection rules to one or more data objects.

DETAILED DESCRIPTION OF THE INVENTION

The present invention provides rail inspection data processing systems that may be used to process and integrate magnetic induction sensor data and ultrasonic sensor data to produce combined inspection system defect files.

Figure 1:
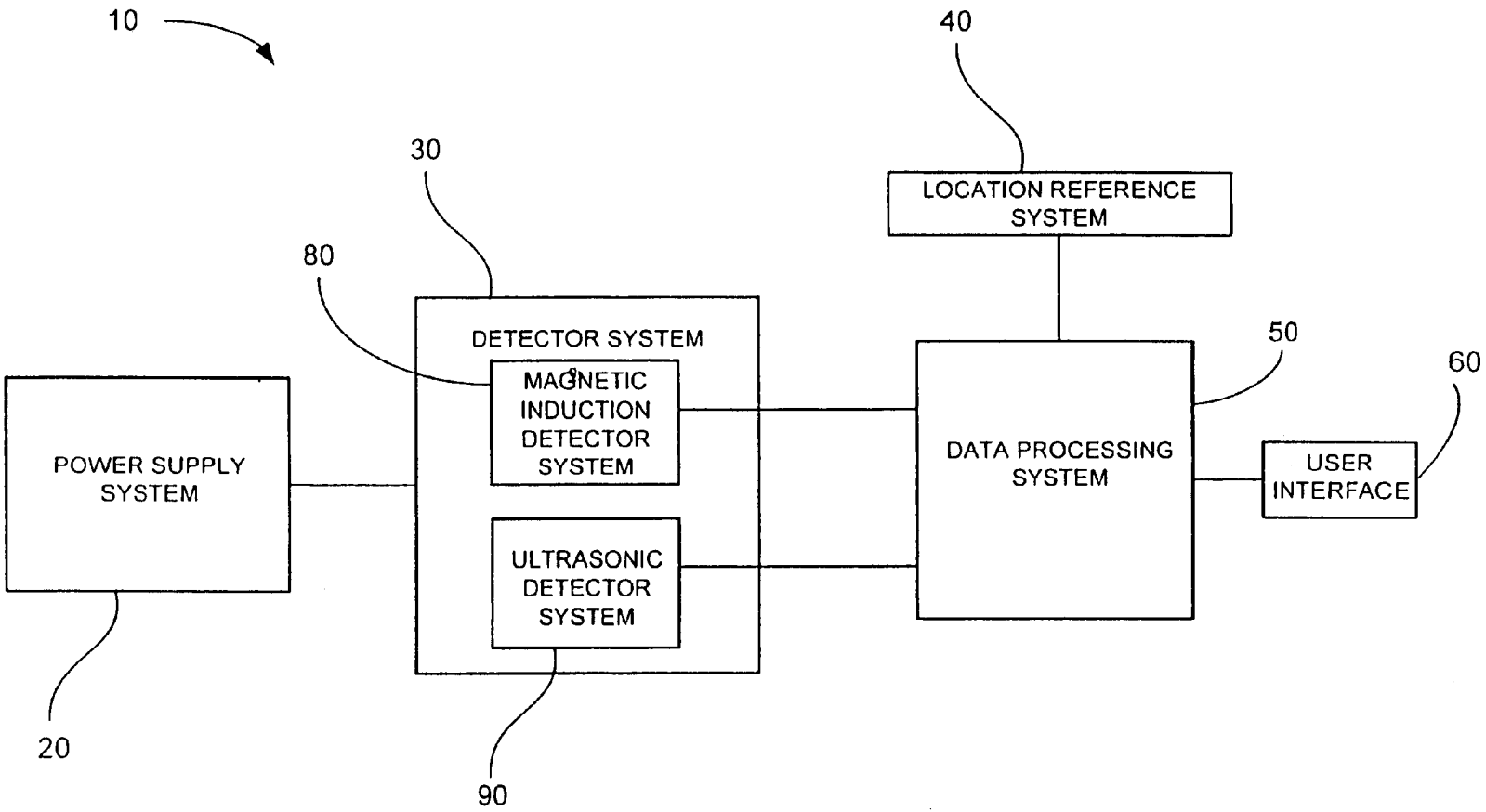
FIG. 1 is a schematic representation of a rail inspection system that may be use in conjunction with embodiments of the invention.

The data processing systems of the invention may be used in conjunction with any rail inspection system comprising an ultrasonic detector system, a magnetic induction sensor system or both. FIG. 1 is a schematic representation of an illustrative rail inspection system 10 having a power supply system 20, a detector system 30, a location reference system 40, a data processing system 50 and a user interface 60. The detector system 30 includes a magnetic induction detector system 80 and an ultrasonic detector system 90.

Figure 2:
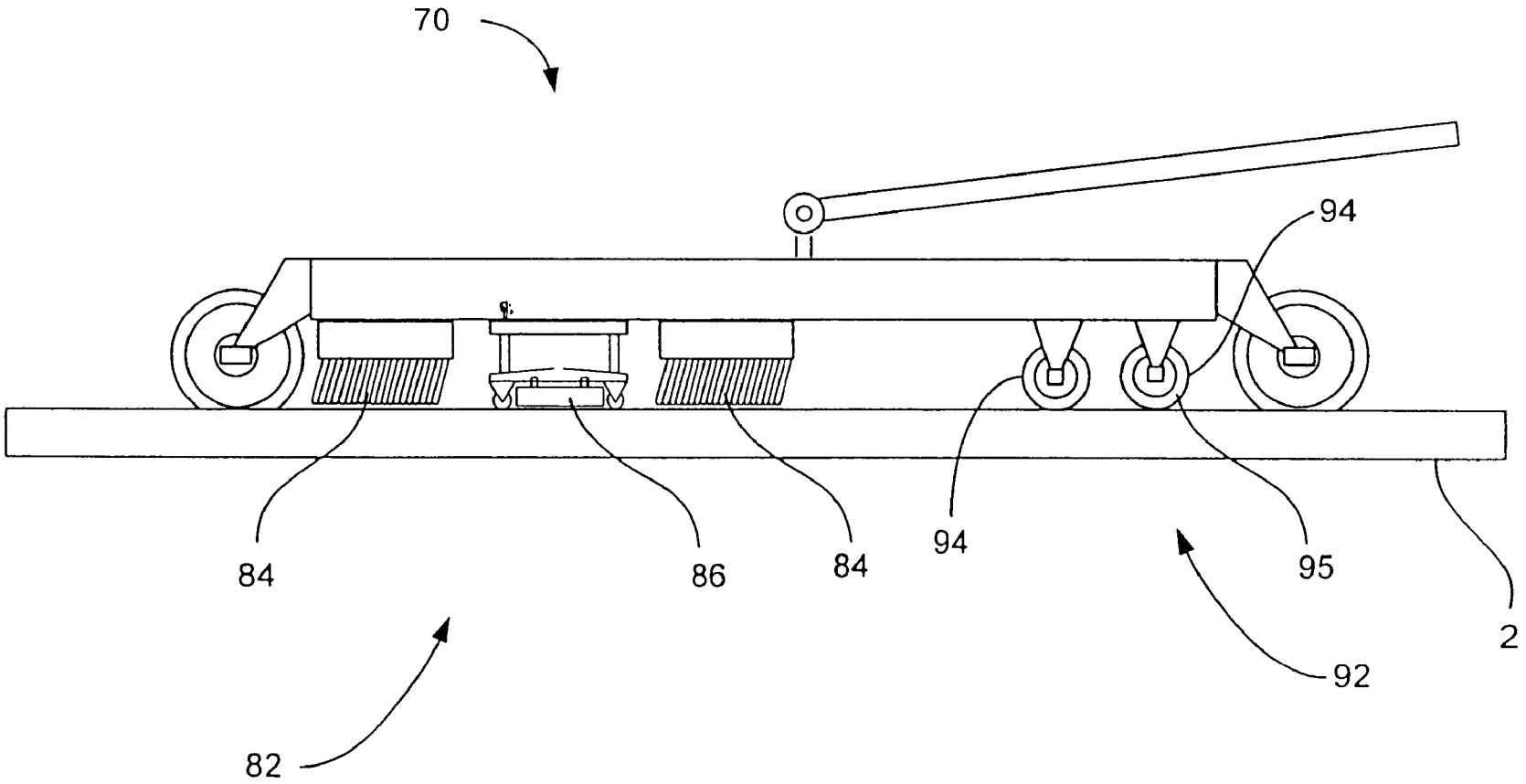
FIG. 2 is a side view of a detector carriage having magnetic induction and ultrasonic sensor systems attached thereto.

Magnetic induction detector systems and ultrasonic detector system used for inspection of railroad rails typically include sensor systems mounted to a carriage that can be drawn along the rails. An exemplary rail-traveling carriage 70 is shown in FIG. 2. The carriage 70 has mounted thereon a magnetic induction sensor system 82 and an ultrasonic sensor system 92, which may be included in the magnetic induction detector system 80 and the ultrasonic detector system 90, respectively. It will be understood that although only the sensors for inspecting one rail 2 are visible in FIG. 2, the carriage 70 may include sensors for simultaneous inspection of both rails of a railroad track.

The magnetic induction sensor system 82 includes a pair of brushes 84 in selective contact with the rail 2. The brushes 84 receive power from the power supply system 20 and are used to conduct a heavy saturating current into the rail 2. This current establishes a magnetic field around the rail 2 in the area between the brushes 84. An induction sensor unit (ISU) 86 positioned just above the rail 2 is used to sense perturbations in the magnetic field. Amplified signals from the ISU 86 are sent to the data processing system 50, which analyzes the signals and compares the associated perturbations with known defect profiles.

The ultrasonic sensor system 92 includes one or more roller search units (RSUs) 94. Each RSU 94 comprises a fluid-filled wheel 95 formed of a pliant material that deforms to establish a contact surface when the wheel 95 is pressed against the rail 2. The fluid-filled wheel 95 is mounted on an axle attached to the RSU frame so that the fluid-filled wheel 95 contacts the rail 2 and rolls along the rail 2 as the detector carriage 70 is pulled along the track. The RSU 94 includes ultrasonic transducers (not shown) mounted inside the fluid-filled wheel 95. The ultrasonic transducers are configured and positioned for transmitting ultrasonic beams through the fluid in the wheel 95 and through the contact surface into the rail 2 and for receiving the reflected beams from the rail 2. The transducers generate return signals that are transmitted to the data processing system 50.

The RSUs 94 and the ISU 86 are spatially separated along the length of the carriage 70. As a result, at a given instant in time, each of the sensor units is inspecting a different location along the rail 2. As will be discussed in more detail hereafter, the data processing system 50 uses a location reference module 40 to generate pulses that can be associated with specific rail locations. Each of these pulses is assigned a synchronization pulse number that can be associated with data objects constructed from data received from the various sensors as they pass over a given rail location. This allows the integration of data obtained at the same location but at different times.

The data processing system 50 uses the data objects from multiple sensors to assemble a defect file that can be provided to an operator along with data from individual sensors using the user interface 60.

Figure 3:
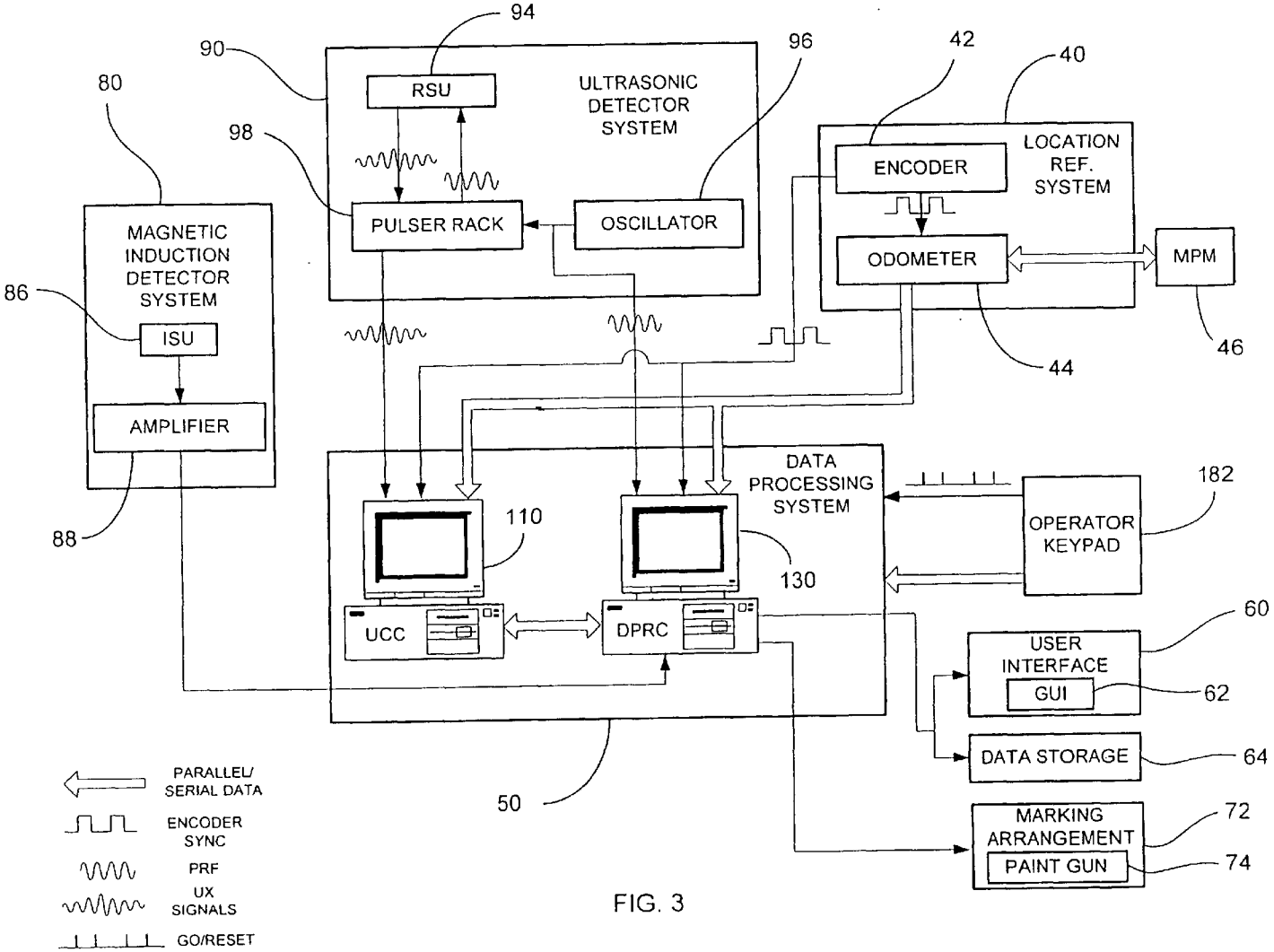
FIG. 3 is a block diagram of a data processing system according to an embodiment of the invention, the block diagram illustrating the flow of data between the data processing system and various components of a rail inspection system.

FIG. 3 is a block diagram illustrating the flow of data to and from the data processing system 50 and other subsystems of the inspection system 10. In the illustrated embodiment, the data processing system 50 uses two data processors for processing rail inspection data: an ultrasonic control computer (UCC) 110 and a data processing and recording computer (DPRC) 130. The UCC 110 and the DPRC 130 may use the Windows NT operating system or other personal computer operating system and are networked so that information files can be shared.

It will be understood by those having ordinary skill in the art that the data processing system 50 may comprise any number of data processors. A single processor of sufficient size and speed may be used in place of the UCC 110 and the DPRC 130. Alternatively, the functions of the UCC 110 and the DPRC 130 may be shared by more than two networked processors.

As will be discussed in more detail below, raw ultrasonic data from the RSUs 94 is received and processed by the UCC 110, then passed to the DPRC 130, which uses the processed data to construct ultrasonic data objects. Raw magnetic induction data from the ISUs 86 is passed through an amplifier 88, then passed directly to the DPRC 130 where it is processed and used to form induction data objects.

In typical operation for an inspection system 10 having one ISU 86 per rail and two RSUs 94 per rail, the data processing system 50 may be configured to processes 24 channels of ultrasonic data (12 channels per rail) and 8 channels (4 channels per rail) of induction data. The system design may provide spare input channels that can be used for additional ultrasonic or induction sensors or other sensors providing analog or digital data. The additional channels allow operation of the inspection system 10 to be customized to meet the needs of various rail testing requirements. The use of these spare channels may be defined in a setup file in the DPRC 130.

Because they are not co-located on the carriage 70, the ISU 86 and RSUs 94 do not examine the same rail location at the same time. Accordingly, direct time synchronized data is insufficient for correlating defect information from the two sensor systems. The data processing system 50 of the present invention therefore associates data with a synchronized location-based pulse provided by the location reference system 40. All data processed from both the induction and ultrasonic sensors are associated with an encoder synchronization pulse generated by an encoder 42. The encoder 42 is a pulse generator coupled to a rail wheel or associated axle of the vehicle used to propel the carriage 70 along the rails. The encoder 42 is preferably coupled to an unbraked rail wheel of the carriage-propelling vehicle. The encoder 42 could alternatively be coupled to a wheel of the detector carriage 70 itself.

The encoder 42 pulses at a frequency proportional to the revolution frequency of the vehicle wheel, thereby providing a two phase square wave signal as a function of distance traveled. Each pulse so-generated is therefore associated with a specific location on the rail 2 over which the vehicle wheel (and the carriage 70) is rolling. The data processing system 50 assigns a synchronization pulse number to each pulse and assures that this pulse number is properly associated with all sensor data obtained for the given location. As will be discussed, this allows data objects from non-colocated sensor systems to be combined in assessing defects.

Some information may be provided to the data processing system 50 through an operator keypad 182. This information may include data such as an identification number for the track being inspected. The operator also may initiate a start/reset signal from the operator keypad 182. The start/reset signal has the effect of initializing or reinitializing the synchronization pulse number to zero, typically for the start of a new test run.

Processing of the ultrasonic data will now be discussed in more detail. The ultrasonic data comprises ultrasonic (UX) signals produced by the ultrasonic transducers in the RSUs 94. The ultrasonic transducers are excited by signals from a pulser rack 98 driven by an oscillator 96. The oscillator 96 produces a signal with a preset pulse repetition frequency (PRF) that the pulser rack 98 uses to trigger pulses to the transducers. The PRF is greater than or equal to the frequency of the pulses generated by the encoder 42. This assures that the raw data acquisition frequency is greater than the rate at which the data is "sampled" within the data processing system 50 for association with a synchronization pulse number. As long as this is the case, the sample resolution of the UX data may be made independent of the speed of the detector carriage 70.

Figure 4:
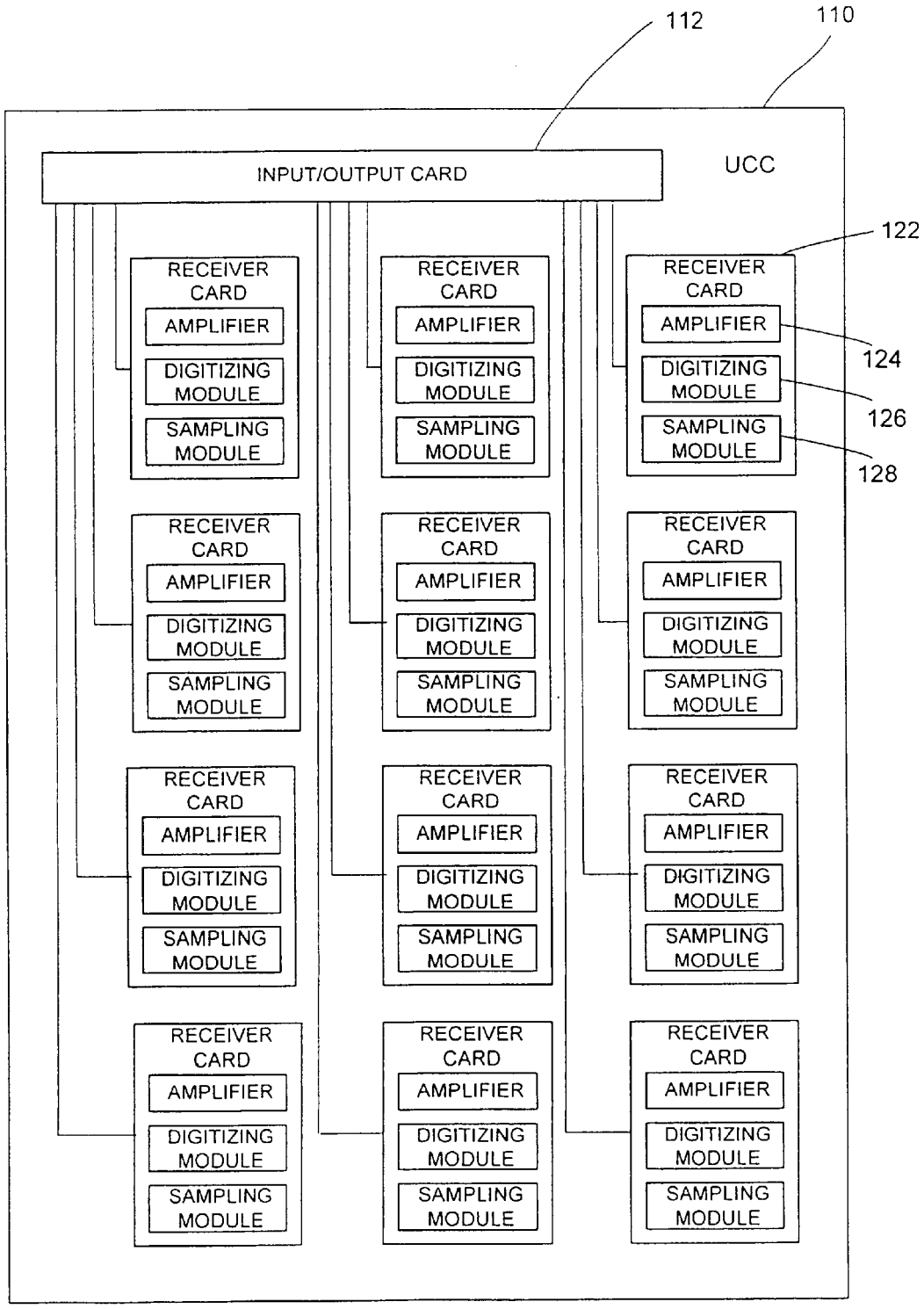
FIG. 4 is a block diagram of an ultrasonic control computer (UCC) of a data processing system according to an embodiment of the invention.

FIG. 4 illustrates a block diagram of a UCC 110 according to a preferred embodiment. The UCC 110 comprises an input/output card 112 and a plurality of ultrasonic data receiver cards 122. As shown in FIG. 3, the UCC 110 is in communication with the ultrasonic detector system 90, the location reference system 40 and the DPRC 130.

When ultrasonic data is being acquired, UX signals from the RSUs 94 are passed through the pulser rack 98 to the receiver cards 122 of the UCC 110 as raw unfiltered analog signals. Each receiver card 122 may be configured to process two channels of data. Thus, twelve receiver cards may be used to process 24 channels of ultrasonic data. Each receiver card 122 includes an amplifier 122, a digitizing module 124 and a sampling module 128. The analog UX signals are amplified by the amplifier 124 and are preferably filtered. The filtered signal may then be further amplified or attenuated according to automatic gain control settings. The signals are then digitized by the digitizing module 126 so that they are represented by computer readable words made up of binary ones and zeros.

Once digitized, the data are sent to the sampling module 128 which assembles the data into a data set including channel number, amplitude and depth. A "lack of signal" code may also be provided. The data set may also be labeled with a first data integrity pulse count, which can be compared to a UIB-generated second data integrity pulse count as will be discussed. The first data integrity pulse count is generated by the input/output card 112, which receives the pulse count synchronization signal, start/reset signal, and signals produced by the encoder 42. The input/output card 112 includes an 8-bit counter (not shown) that counts the encoder pulses to generate the first integrity pulse count. The counter resets to zero after reaching a predetermined counter limit.

The digitized data is acquired by the receiver cards 122 at a fixed sampling rate (i.e., the PRF). The sampling module 128 is configured to sample the data as a function of distance in response to the encoder pulse. This is accomplished using time frames called gating intervals to sample the data. These gating intervals are established based on the location-based encoder pulse produced by the encoder 42 of the location reference system 40. The sampling module 128 assesses the data obtained during a gating interval to determine if an ultrasonic return is present during that period. If so, the sampling module 128 checks to see if the return has an amplitude that is greater than a predetermined threshold voltage. If the return amplitude exceeds the predetermined threshold, the data set is sent to the DPRC 130.

In an alternative embodiment, the functions of the digitizing module 124 may be performed in conjunction with the sampling of the data by the sampling module 128. In such an embodiment, only the data obtained during gating intervals is digitized. This data is then assessed to determine if it includes a return with an amplitude exceeding the preset threshold, in which case it is sent to the DPRC 130.

Figure 5:
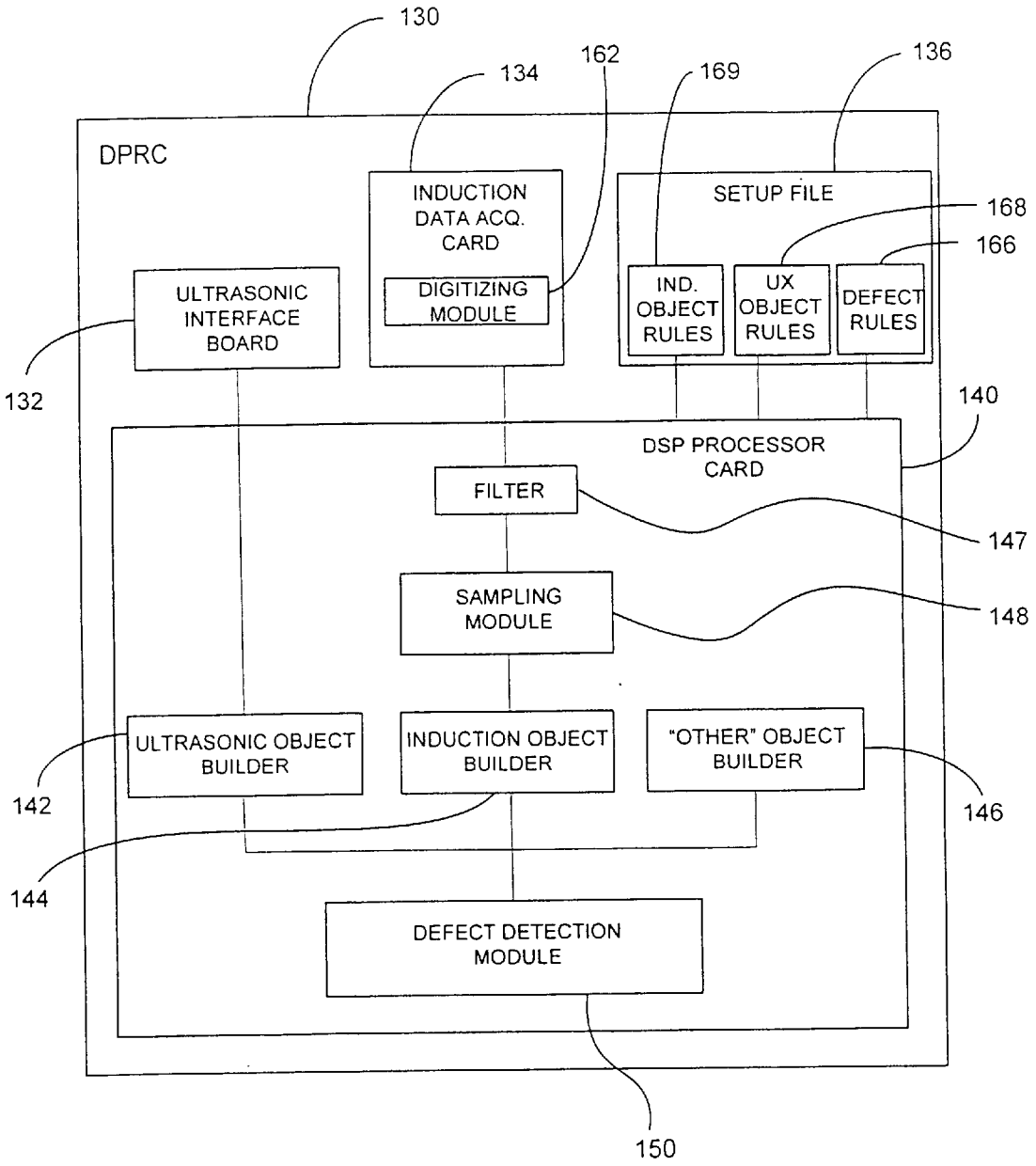
FIG. 5 is a block diagram of a data processing and recording computer (DPRC) of a data processing system according to an embodiment of the invention.

A block diagram of a DPRC 130 according to a preferred embodiment is shown in FIG. 5. The DPRC 130 includes an ultrasonic interface board (UIB) 132, one or more induction data acquisition cards 134 and a digital signal processing (DSP) processor card 140. Although the illustrated embodiment includes a single DSP processor card 140, it will be understood by those having ordinary skill in the art that the components and functions of the DSP processor card 140 may be divided among a plurality of DSP processor cards. The DPRC 130 may also include a setup file 136, which may be used to establish operating parameters that may vary depending on the inspection system configuration or operating environment.

The UIB 132 is configured to receive and process the ultrasonic return data sets sent to the DPRC 130 by the UCC 110. The UIB 132 reformats the data to add a synchronization pulse number and milepost information. Milepost information is provided by a subsystem of the location reference system 40 referred to as an odometer 42. The odometer 42 uses information from a mile post monitor (MPM) 46 to track the distance traveled along the railroad track. The MPM 46 provides the current mileage location along the track and allows the operator to synchronize the mileage being reported to the DPRC 130 to that of physical mileage markers along the track. Information related to other physical landmarks may also be entered to adjust the mileage location.

The UIB 132 generates a second data integrity pulse count using a second 8-bit counter. The UIB 132 then compares the second data integrity pulse count to the first data integrity pulse count generated by the UCC 110 to assure that they are the same. If a discrepancy is detected, the DPRC 130 is alerted for remedial action.

The resulting ultrasonic data set, which includes the synchronization pulse number is streamed to the DSP processor card 140. The DSP processor card 140 includes an ultrasonic object builder 142, which creates ultrasonic data objects according to ultrasonic object rules 168 set forth in the setup file 136. The ultrasonic object rules 168 and other parameters in the setup file 136 may be changed by an operator at any time when the data processing system 50 is off-line.

The UCC 110 provides to the DPRC 130 only ultrasonic data sets having a return amplitude greater than a threshold value. The ultrasonic data object builder 142 reviews these data sets to identify spatially sequential data set groups. Ultrasonic objects are created from spatially sequential data set groups that, taken together, represent a rail length that exceeds a predetermined minimum rail length. By using a minimum rail length corresponding to the smallest defect dimension of concern, the data processing system 50 is able to automatically evaluate and discard spurious signals and signals relating to non-defect discontinuities in the rail. Additional limitations may be placed on object creation based on depth (range) and return angle. Such additional limitations allow a high degree of precision in evaluating ultrasonically identified defects.

Each ultrasonic data object may be described by its length, amplitude, depth and synchronization pulse number. Start and end depth may also be saved, which allows the calculation of object angle and other characteristics.

As will be discussed, the DSP processor card 140 also includes a defect detection module 150, which uses ultrasonic data objects along with data objects from other sensors and/or non-sensor sources to create a defect file.

Turning now to the processing of magnetic induction test data, signals from the ISUs 86 are provided to the data processing system 50 in the form of voltages that vary as a function of disruptions in the magnetic field caused by rail discontinuities. The raw voltage induction data from the ISUs 86 is amplified by the amplifier 88 then sent to the DPRC 130.

The amplified voltage data is received by an induction data acquisition card 134 in the DPRC 130. The induction data acquisition card 134 includes a digitizing module 162 that samples the amplified voltage data independent of carriage speed and digitizes the sampled data. The sampled data is then passed to the DSP processor card 140 where it is passed through a filter 147 to remove noise. The data is then sent to an induction data sampling module 148, which uses the encoder pulse to resample the data to establish an induction data set that can be associated with a specific synchronization pulse number. The filtered data is resampled to provide the sensor's measured field value at each encoder sync pulse, which in turn provides a data stream at a fixed rate per unit distance. This data is then scaled to correct for vehicle speed and may also have other corrections applied to it as defined in the setup file. The filtered, scaled, resampled data is then made available for display and/or storage.

The induction data sampling module 148 also passes the filtered, scaled, resampled data stream to an induction data object builder 144. The induction data object builder 144 performs an envelope detection algorithm to determine the magnitude of the field strength at each encoder sync pulse. This envelope detection algorithm takes into account the unique nature of the bipolar signal generated by the ISU 86 and the fact that the ISU 86 behaves like a high pass filter. Once the envelope has been computed, a predetermined threshold is applied to create an induction data object according to induction data object rules 169 set forth in the setup file 136. The induction data object builder 144 calculates the RMS (root mean square) signal value over the span of the object. The induction data object is described in terms of length, (RMS) amplitude and encoder pulse number. No depth information is included in the induction data object. The induction data object may then be stored for display. The induction data object may also be buffered for combination with other data objects.

The DPRC 130 thus produces and stores induction data objects and ultrasonic data objects. The DPRC 130 also retains the raw induction data, although not in object form. The raw induction data is instead saved in record form, including all analog values for each pulse along with the pulse number. This allows the raw data to be spatially displayed with the induction and ultrasonic data objects. The DSP processor card 140 of the DPRC 130 may also include one or more other object builders 146 to create data objects from other forms of sensor data such as, for example, digital video data representing the three visible rail surfaces or laser profile measurement data such as may be used to detect the joint bars connecting rail segments.

The DSP processor card 140 may include a defect detection module 150 configured to compare known defect profiles to data objects generated by the data object builders 142, 144, 146. These defect profiles may be retrieved from a defect table stored anywhere in the DPRC and maintained by the setup file 136. The defect detection module 150 is configured to determine, based on preset defect detection rules 166, whether any of the data objects constructed from the ultrasonic and induction data streams should be marked as a suspected defect. Objects so-marked are referred to as system marked objects (SMOs). SMOs are flagged in the final data stream by the defect detection module 150 and made available to the user interface 60. The defect detection rules 166 are independent of data object type and therefore treat ultrasonic and induction data objects alike. This allows defects to be defined as a combination of various object types.

It will be understood by those having ordinary skill in the art that the defect detection rules may be defined so as to identify and/or discriminate features that are not actually defects, but are instead regularly occurring rail features such as bolt holes.

The defect detection rules 166 may be highly flexible. The DPRC 130 is preferably configured so that an operator can change the defect detection rules 166 by modifying the setup file 136. This can be done at any time when the data processing system 50 is off-line.

An important aspect of the data processing system 50 is the ability of the system to correlate data objects from different channels and, more importantly, different data types. This is accomplished through the determination and assignation of a synchronization pulse number to all data objects. The synchronization pulse number describes the position of the start of an object and thus can be used to spatially determine where an object occurred along the rail being examined. The object can thus be assembled with other objects occurring at the same spatial location. Offset parameters in the setup file 136 allow the data from different sensors to be aligned independent of their physical position on the detector carriage 70. This is significant because the spatial location of the ISU 86 may differ from the location of an RSU 94 by several feet. The defect detection module 150 must also correct the spatial location of ultrasonic objects to account for sensor angle, the effect of which is to make objects deep in the rail appear to be further ahead or behind the location of the RSU 94 than they actually are. Alternatively, spatial location correction can be accomplished prior to or during data object construction.

Accordingly, induction and ultrasonic data objects may be cross referenced by the defect detection module 150 in any combination. This allows defect assessment based on criteria that uses both types of data. The DPRC software includes algorithms that analyze the data from both sensor types in order to determine the presence of defects. These algorithms look at data amplitude, location in the rail, duration or length of the indication and the combination of signals from different channels and techniques. This allows the system to establish internal confirmation of defects detectable by both techniques. To further enhance defect determination, the defect detection module 150 may be programmed to use AND, OR, and NOT type constructs as part of the defect definition. This allows, for example, the automatic discrimination of suspected defects identified by only one sensor type from those identified by both sensor types.

Association of all data with a synchronization pulse number allows all induction objects, ultrasonic data objects, and analog induction records to be spatially correlated for plotting on a graphical user interface (GUI) 62. The GUI 62 may provide the operator with a variety of information along with visual representations of the induction and ultrasonic data objects and the raw induction data.

All data objects and the raw induction data are available to the operator of an inspection system 10 through the user interface 60. All data objects and the raw induction data may also be sent to a data storage device 64. The data storage device 64 may use any processor-readable medium for storage of the data but preferably uses a removable medium that can be easily removed and read by another processor. The data objects, with all SMOs flagged, may be stored as B-Scan files that can be read offline using B-Scan software. The ultrasonic and induction object data may be kept in its entirety. All analog data may be viewed when the system is operated in the on-line mode. Normally, only a limited amount of analog induction data is available for off-line use; specifically, the analog data in the areas adjoining the location of confirmed defects and operator selected rail data sections. Optionally, the system operator can elect to save all analog data prior to the start of a test. This facilitates full off-line analysis of track with unusual characteristics as well as a periodic review of the system operation.

The data processing system 170 can be used to assemble, correlate and present data from the detection units in real time. This allows the operator to view and confirm suspect defects on a B-scan display during data capture using the GUI 62. Data can also be buffered to allow the operator to perform B-scan analysis whenever the opportunity presents itself during a test run.

If there are more suspected defects than the operator has time to view during the run, analysis may be completed after the test has been ended. This allows the system to be used in a continuous, non-stop mode in addition to a stop-and-confirm mode. The system can also be used in conjunction with a chase car methodology wherein the location of a suspected defect is relayed to a second vehicle, which performs a detailed inspection of the suspect location.

Although not essential, a visual observation of the rails can supplement the displayed data. As a way of assisting the operator in making rapid decisions regarding the necessity of visual observation and the nature of identified defects, the data processing system 50 may incorporate the use of artificial intelligence in the form of neural networks. These networks can be used as a way for the system to "learn" to identify defect types and assess their severity.

The inspection system 10 may include a marking arrangement 72 to physically mark the location of a defect on the rail in response to an automatic determination that a suspected defect meets the predetermined criteria of an SMO. This allows the location of the defect to be easily identified visually so that the defect can be verified with the use of manual instruments. The marking arrangement 72 may make use of one or more precision paint spray guns mounted on the detector carriage 70 and electronically controlled by the DPRC 130. When specific defect criteria are met, the DPRC 130 provides a time critical signal that triggers the spray gun, which in turn paints the rail according to the signal it receives. By properly controlling the timing of the signal, the DPRC 130 can cause the paint gun to mark the rail at the exact point of the suspected defect. The setup file 136 in the DPRC 130 may include offset parameters to allow painting to occur at the proper location based on information from sensors located at differing locations on the detector carriage 70. Paint may be sprayed in various locations in order to assist in determining flaw location, not only along the rail, but also its location within the rail cross section.

Figure 6:
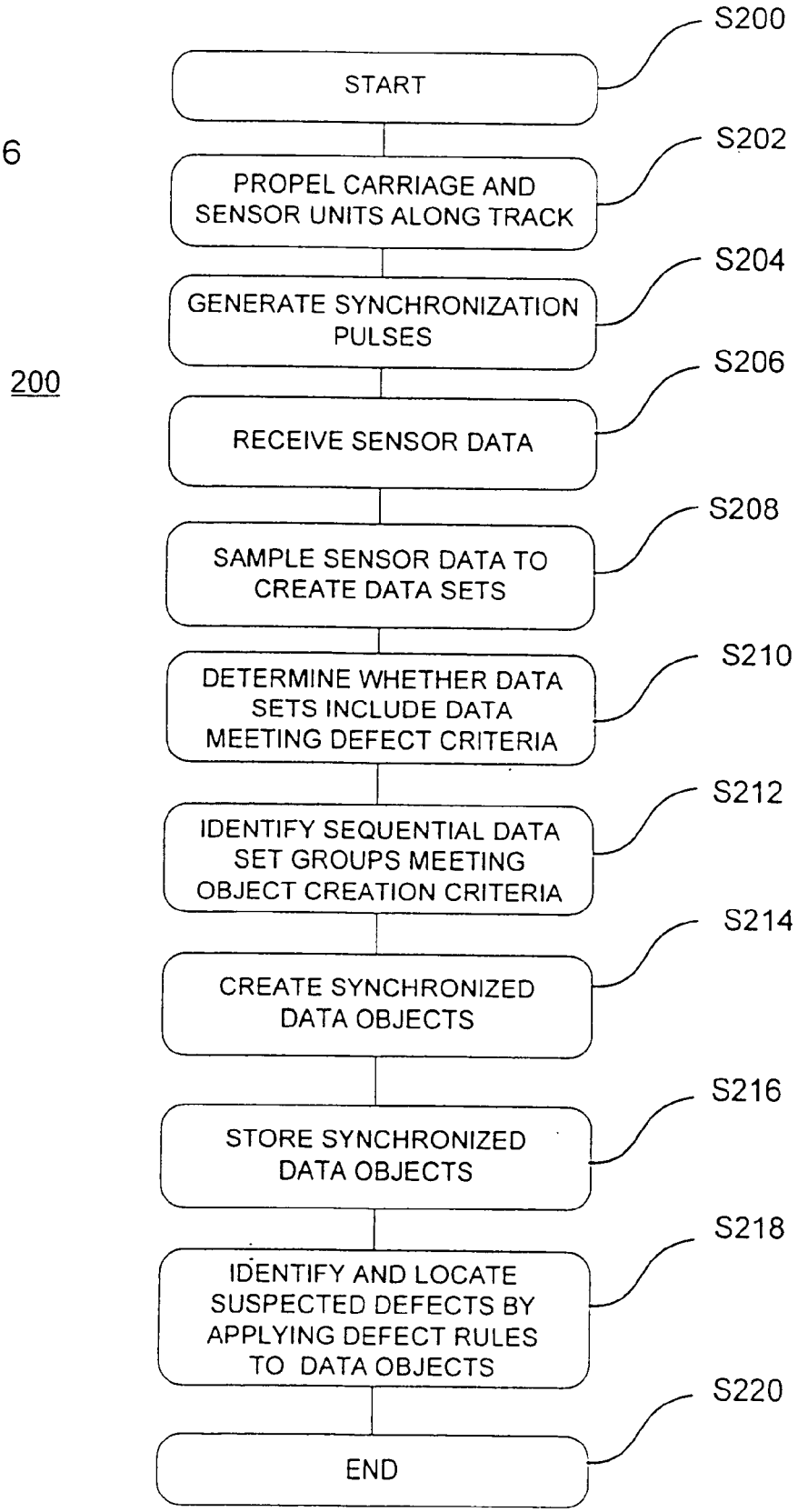
FIG. 6 is a flow diagram illustrating steps in a method of processing rail inspection system data according to one aspect of the invention.

The ability of the data processing system 50 to automatically assemble and assess data objects from both induction and ultrasonic sensor systems significantly enhances the reliability of the inspection system 10 generally and more particularly the utility of the marking arrangement 72. The ability to integrate flaw detection by multiple sensor systems significantly reduces the number of marked defects that must be manually inspected. FIG. 6 illustrates steps in a method 200 of identifying defects using data objects from multiple sensor inputs. The sensor units used may be mounted to a rail traveling carriage such as the carriage 70 shown in FIG. 2. The method 200 begins at step S200. At step S202, the carriage and attached sensor units are propelled along the track. At step S204, the inspection system generates synchronization pulses as a function of distance traveled along the rails. This may be accomplished using the previously described encoder 40.

At step S206, data from the sensor units is received by a data processing system such as, for example, the previously described data processing system 50. The sensor data is sampled at step S208 to create sensor data sets. Each sensor data set includes sensor data from a single rail location obtained by one sensor unit. At step S210, each data set is evaluated to determine whether data within the data set meets a set of predetermined defect criteria. Such criteria may include for example an amplitude threshold, which when exceeded, suggests that the sensor has detected a non-uniformity within the rail that could be part of a defect.

At step 212, the data processing system reviews the data sets that include data meeting the suspected defect criteria. For each sensor unit, the data processing system identifies groups of spatially sequential data sets that collectively meet a set of predetermined object creation criteria. Such criteria may include for example a minimum length. Only those groups with data sets spanning a rail length greater than the minimum length would be processed as suspected defects. The length of the suspected defect may be determined using the synchronization pulse numbers associated with the sequentially first data set in the group and the sequentially last data set in the group.

At step S214, the data processing system creates a synchronized data object from those data set groups meeting the object creation criteria. The synchronized data object may be described by synchronization pulse number, object length and other data parameters. The synchronization pulse number of the object is preferably the synchronization pulse number of the sequentially first data set in the group from which the object is created. The length of the object is the span from the sequentially first data set to the sequentially last data set in the group. At step S216, data objects created by the data processing system are stored or buffered. At step 218, the data objects for a given location (i.e., a particular synchronization pulse number or range of synchronization pulse numbers) are used to identify and locate suspected defects. This is accomplished by applying defect detection rules to the various data objects. The defect detection rules include criteria for object comparison and combination that are use to determine if a rail location should be identified as having a suspected defect. Importantly, the defect detection rules may be applied to all data objects without regard to the type of sensor used to generate the data from which the data object was created. The method ends at step S220.

The method 200 may be used to process any type of sensor data including but not limited to ultrasonic sensor data, magnetic induction data, digital video data and laser profile measurement data.

Figure 7:
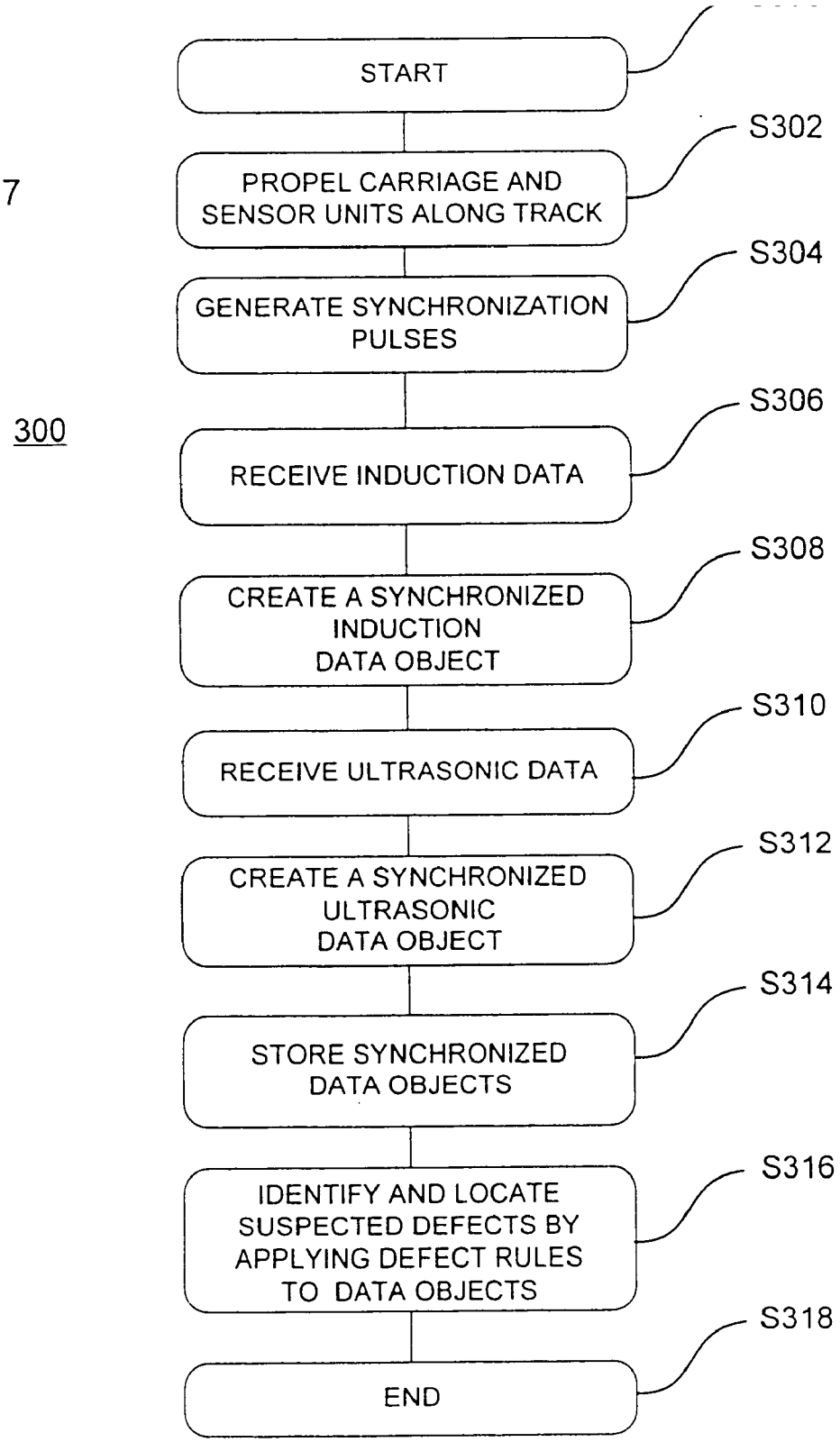
FIG. 7 is a flow diagram illustrating steps in a method of processing rail inspection system data according to one aspect of the invention.

FIG. 7 illustrates steps in a method 300 of identifying suspected rail defects by processing and integrating data from ultrasonic sensors and magnetic induction sensors. The ultrasonic and magnetic induction sensor units may be mounted to a rail traveling carriage such as the carriage 70 shown in FIG. 2. The method 300 begins at step S300. At step S302, the carriage and attached sensor units are propelled along the track. At step S304, the inspection system generates synchronization pulses as a function of distance traveled along the rails. This may be accomplished using the previously described encoder 40.

At step S306, induction data in the form of amplified voltages from the induction sensor unit is received by a data processing system. The data may be received, for example by the DPRC 130 of the data processing system 50. At step S308, the induction data is used to create an induction data object that includes a pulse synchronization number that associates the induction data object with a rail location. The induction data object may also include information relating to object length and (RMS) amplitude.

At step S310, ultrasonic data in the form of raw UX signals is received by the data processing system. The ultrasonic signals may, for example be received by the UCC 110 of the data processing system 50, which, along with the DPRC 130 would process the ultrasonic data. At step S312, the ultrasonic data is used to create an ultrasonic data object that includes a pulse synchronization number that associates the ultrasonic data object with a specific rail location. The ultrasonic data object may also include information relating to length, amplitude and depth.

At step S314, the induction and ultrasonic data objects are stored or buffered. Defect rules are applied to the induction and ultrasonic data objects to identify suspected defects at step S316. The defect detection rules define a set of criteria for establishing whether a defect (or other feature) should be suspected at a particular track location. Data objects from sensors other than the ultrasonic and magnetic induction sensors may be included as well. The defect detection rules may be applied to data objects without regard to the sensor type used to generate the objects. Synchronization of all data objects based on location allows objects generated from different sensors to be used in combination to assess whether a defect is present at a given location. The method 300 ends at step S318.

Figure 8:
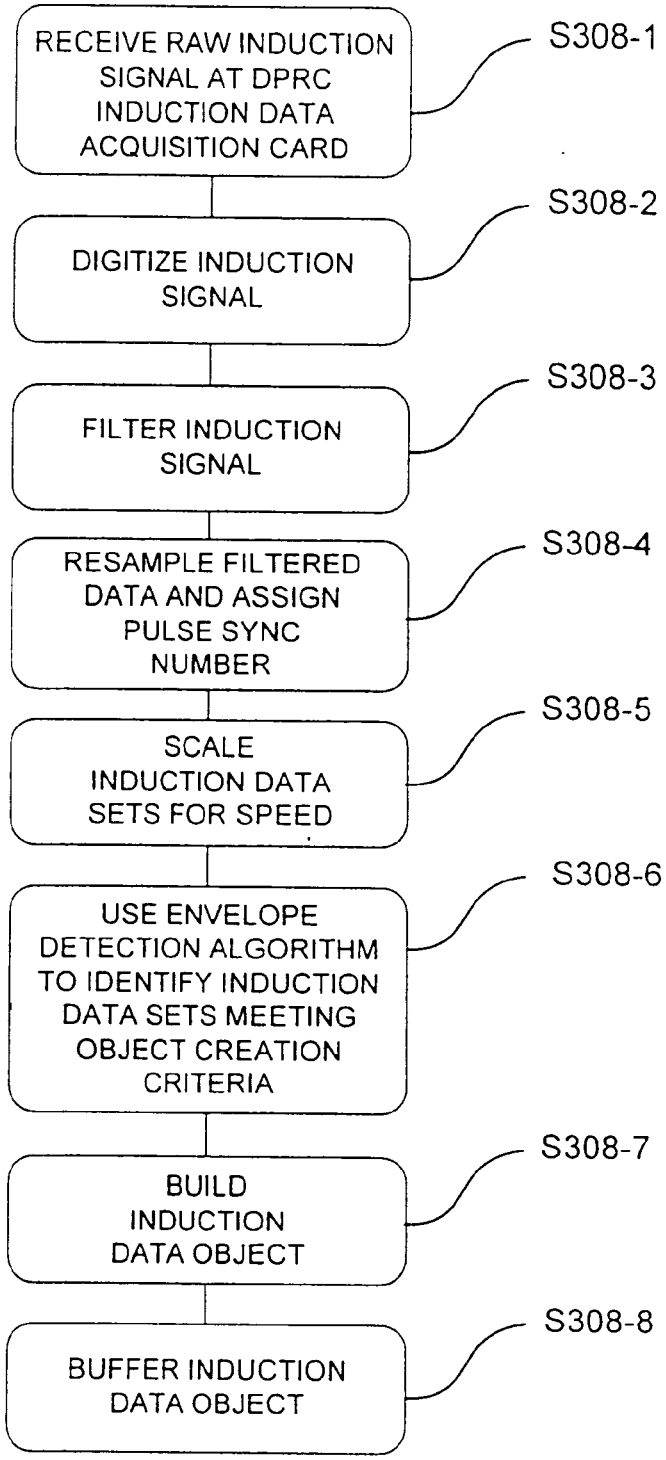
FIG. 8 is a flow diagram illustrating steps in a method of building an induction data object according to one aspect of the invention.

The method 300 may be carried out using the data processing system 50 (or other embodiments) of the present invention. As carried out by the data processing system 50, Step S308 (creating a synchronized induction data object) of the method 300 may include the steps shown in FIG. 8. At step S308-1, the amplified raw induction data signal is received by the induction data acquisition card 134 of the DPRC 130. At step S308-2, the digitizing module 162 samples the amplified induction signal independent of carriage speed and digitizes the signal to produce digitized induction data.

The digitized induction data is sent to the DSP processing card 147 where it is passed through the filter 147 at step S308-3. The sampling module 148 resamples the data and assigns a pulse synchronization number to each sample at step S308-4. As previously described, the pulse synchronization number synchronizes the data relative to a common rail location reference. The induction data may then be scaled for speed at step S308-5. The filtered, resampled and scaled induction data may then be passed to the induction data object builder 144. At step S308-6, the induction data object builder uses an envelope detection algorithm to determine if a predetermined induction data amplitude threshold has been exceeded over a length exceeding a predetermined minimum length. Data sets identified by the envelope detection algorithm as meeting the amplitude and length criteria are used by the induction data object builder 144 to build induction data objects at step S308-7. Each induction data object includes a synchronization pulse number associated with the sequentially first induction data set used to create the induction data object. The induction data object may be buffered for combination or use with other data objects at step S308-8.

Figure 9:
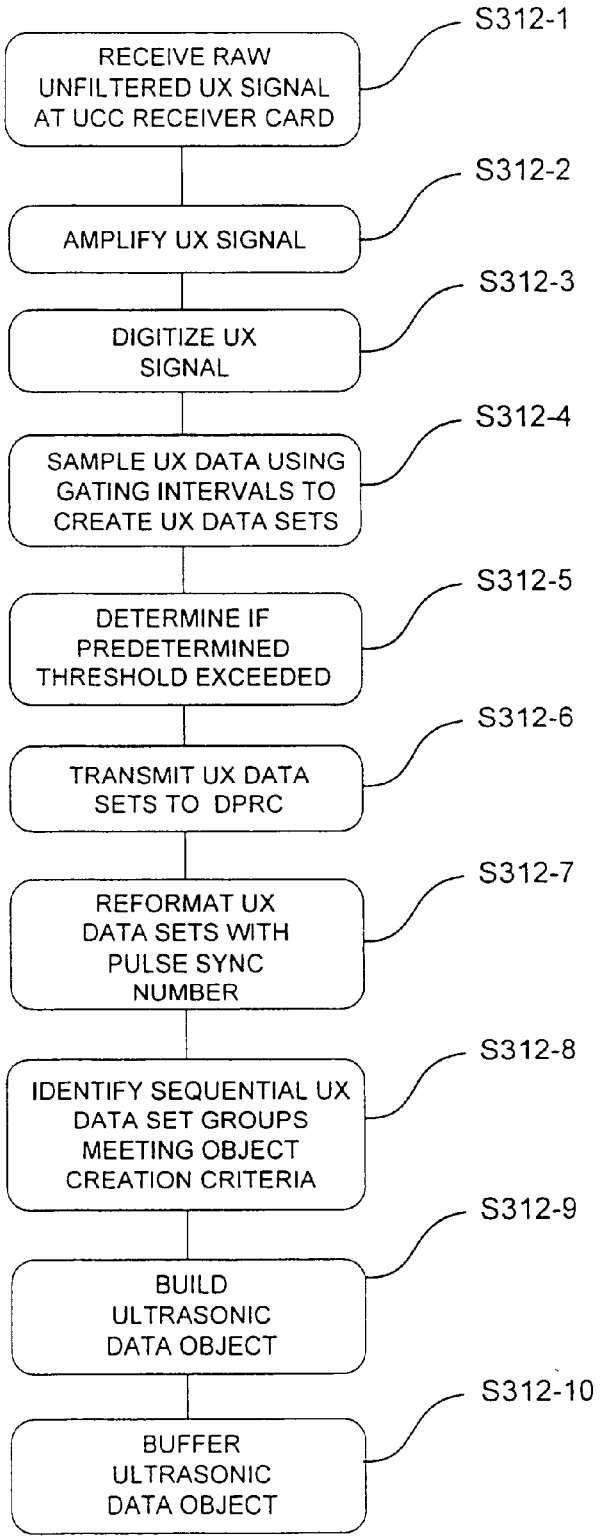
FIG. 9 is a flow diagram illustrating steps in a method of building an ultrasonic data object according to one aspect of the invention.

As carried out by the data processing system 50, Step S312 (creating a synchronized ultrasonic data object) of the method 300 may include the steps shown in FIG. 9. At step S312-1, raw unfiltered ultrasonic signals are received by a receiver card 122 of the UCC 110. At step S312-2, the ultrasonic signal is amplified using an amplifier 124 on the receiver card 122. A digitizing module 124 on the receiver card 122 is then used to digitize the ultrasonic signal at step S312-3. The data is then sampled by the ultrasonic data sampling module 128 at step S312-4. The data is sampled using gating intervals in the manner previously described. At step S312-5, the ultrasonic data sampling module 128 determines for each gated interval whether the amplitude of the data exceeds a predetermined threshold. Data sets created using data from intervals wherein the threshold is exceeded are sent to the UIB 132 of the DPRC 130 at step S312-6. At step S312-7, the data sets are reformatted by the UIB 132 to include pulse synchronization numbers. The reformatted data sets are then sent to the ultrasonic object builder 142, which builds an ultrasonic data object at step S312-8 in the manner previously described. Each ultrasonic data object includes a synchronization pulse number associated with the sequentially first ultrasonic data set used to create the ultrasonic data object. The ultrasonic data object may then be buffered for combination or use with other data objects at step S312-9.

It will be understood that the diagrams in FIGS. 6–9 are not intended to imply a particular ordering of the steps in the methods described and the invention is not limited to the sequences shown.

The systems and methods of the invention are highly flexible and may be used in conjunction with any rail inspection system or any other inspection system using ultrasonic sensors, induction sensors or both.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A data processing system for use in conjunction with a rail inspection system having a detection carriage with a plurality of sensor units configured to sense discontinuities in a rail of a railroad track as the detector carriage travels along the railroad track, the system comprising:

a data processing and recording computer connectable to the plurality of sensor units for receiving sensor data therefrom;

at least one processor card in the data processing and recording computer, the at least one processor card including at least one data object builder configured for building data objects using the sensor data from the plurality of sensor units and including means for synchronizing the data objects with respect to location along the rail; and a defect detection module in the data processing and recording computer, the defect detection module being in communication with the at least one data object builder and being configured for using the data objects to determine rail locations having suspected defects.

2. A data processing system according to claim 1 wherein the plurality of sensor units includes at least one ultrasonic sensor unit, the system further comprising:

an ultrasonic control computer in communication with the data processing and recording computer;

a receiver card in the ultrasonic control computer, the receiver card being connectable to at least one ultrasonic sensor unit for receiving ultrasonic sensor data therefrom, the receiver card including an ultrasonic data amplifier, an ultrasonic data digitizing module and an ultrasonic data sampling module; and an ultrasonic interface board in the data processing and recording computer, the ultrasonic interface board being in communication with the receiver card.

3. A data processing system according to claim 2 wherein the at least one data object builder includes an ultrasonic data object builder in communication with the ultrasonic interface board.

4. A data processing system according to claim 2 further comprising a plurality of receiver cards in the ultrasonic control computer, the plurality of receiver cards being in communication with the ultrasonic interface board and being connectable to the at least one ultrasonic sensor unit for receiving ultrasonic sensor data therefrom, each of the plurality of receiver cards including an ultrasonic data amplifier, an ultrasonic data digitizing module and an ultrasonic data sampling module.

5. A data processing system according to claim 1 wherein the plurality of sensor units includes at least one magnetic induction sensor unit, the system further comprising:

an induction data acquisition card in the data processing and recording computer, the induction data acquisition card including a digitizing module; and an induction data sampling module on the at least one processor card, the induction data sampling module being in communication with the induction data acquisition card for receiving digitized induction data therefrom.

6. A data processing system according to claim 5 wherein the at least one data object builder includes an induction data object builder in communication with the induction data sampling module.

7. A data processing system according to claim 1 further comprising a setup file stored in the data processing and recording computer, the setup file including a set of defect detection rules usable by the defect detection module.

8. A data processing system for use in conjunction with a rail inspection system having a detection carriage with a magnetic induction sensor unit and an ultrasonic sensor unit configured to sense discontinuities in a rail of a railroad track as the detector carriage travels along the railroad track, the system comprising:

an ultrasonic control computer connectable to the ultrasonic sensor unit for receiving ultrasonic sensor data therefrom, the ultrasonic control computer including means for digitizing and sampling the ultrasonic sensor data;

a data processing and recording computer having an ultrasonic interface board in communication with the ultrasonic control computer and an induction data acquisition card that is connectable to the induction sensor unit for receiving induction sensor data therefrom; and at least one processor card in the data processing and recording computer, the at least one processor card including an ultrasonic data object builder in communication with the ultrasonic interface board and an induction data object builder in communication with the induction data acquisition card.

9. A data processing system according to claim 8 wherein the ultrasonic data object builder includes means for synchronizing ultrasonic data objects with respect to location along the rail and the induction data object builder includes means for synchronizing induction data objects with respect to location along the rail.

10. A data processing system according to claim 8 further comprising a defect detection module in communication with the ultrasonic data object builder and the induction data object builder.

11. A data processing system according to claim 8 wherein the means for digitizing and sampling the ultrasonic sensor data includes a receiver card including an ultrasonic data amplifier, an ultrasonic data digitizing module and an ultrasonic data sampling module.

12. A data processing system according to claim 8 wherein the induction data acquisition card includes a digitizing module and the at least one processor card includes an induction data sampling module in communication with the induction data acquisition card and the induction data object builder.

13. A data processing system according to claim 8 further comprising a setup file stored in the data processing and recording computer, the setup file including a set of defect detection rules.

14. A data processing system for use in conjunction with a rail inspection system having a detection carriage with a magnetic induction sensor unit and an ultrasonic sensor unit configured to sense discontinuities in a rail of a railroad track as the detector carriage travels along the railroad track, the system comprising:

an ultrasonic control computer connectable to the ultrasonic sensor unit for receiving ultrasonic sensor data therefrom, the ultrasonic control computer including at least one receiver card including an ultrasonic data amplifier, an ultrasonic data digitizing module and an ultrasonic data sampling module;

a data processing and recording computer having an ultrasonic interface board in communication with the ultrasonic control computer and an induction data acquisition card that is connectable to the induction sensor unit for receiving induction sensor data therefrom, the induction data acquisition card including a digitizing module;

at least one processor card in the data processing and recording computer, the at least one processor card including an ultrasonic data object builder in communication with the ultrasonic interface board, an induction data sampling module in communication with the induction data acquisition card and an induction data object builder in communication with the induction data sampling module; and a defect detection module in communication with the ultrasonic data object builder and the induction data object builder.

15. A data processing system according to claim 14 wherein the ultrasonic data object builder includes means for synchronizing ultrasonic data objects with respect to location along the rail and the induction data object builder includes means for synchronizing induction data objects with respect to location along the rail.

16. A data processing system according to claim 14 further comprising a setup file stored in the data processing and recording computer, the setup file including a set of defect detection rules.

17. In a rail inspection system, a method of identifying suspected rail defect locations, the rail inspection system having a data processing system in communication with a plurality of sensor units attached to a rail-traveling carriage, the sensor units being configured to sense discontinuities in a rail of a railroad track as the detector carriage travels along the railroad track, the method comprising:

propelling the detector carriage along the railroad track;

generating periodic synchronization pulses as a function of distance from a fixed reference point on the track, each synchronization pulse being assigned a synchronization pulse number;

obtaining sensor data for a plurality of rail locations, each rail location having an associated synchronization pulse number;

receiving the sensor data at the data processing system;

sampling the sensor data to create sensor data sets, each sensor data set including sensor data from one of the plurality of sensor units taken at one of the plurality of rail locations;

determining for each sensor data set whether the sensor data meets predetermined suspected defect criteria;

identify groups of spatially sequential data sets meeting the predetermined suspected defect criteria, each group including sensor data from only one of the plurality of sensor units, the data sets of each group collectively meeting a set of predetermined object creation criteria;

creating a data object from each group of spatially sequential data sets meeting the set of predetermined object creation criteria, the data object including the synchronization pulse number associated with a selected one of the group of spatially sequential data sets; and identifying suspected rail defects by applying defect detection rules to one or more data objects.

18. A method according to claim 17 wherein the predetermined object creation criteria includes a minimum object length criterion.

19. A method according to claim 17 wherein the selected one of the group of spatially sequential data sets is the spatially sequential data set associated with the lowest synchronization pulse number.

20. A method according to claim 17 wherein the plurality of sensor units includes a magnetic induction sensor unit.

21. A method according to claim 17 wherein the plurality of sensor units includes an ultrasonic sensor unit.

22. A method according to claim 21 wherein the periodic synchronization pulses are generated by an encoder operably associated with a wheel rolling along the rail of the railroad track, the synchronization pulses being proportional to the revolution frequency of the wheel.

23. A method according to claim 17 wherein the periodic synchronization pulses are generated by an encoder operably associated with a wheel rolling along the rail of the railroad track, the synchronization pulses being proportional to the revolution frequency of the wheel.

24. In a rail inspection system, a method of identifying suspected rail defect locations, the rail inspection system having a data processing system in communication with a plurality of sensor units attached to a rail-traveling carriage, the sensor units including a magnetic induction sensor unit and an ultrasonic sensor unit and being configured to sense discontinuities in a rail of a railroad track as the detector carriage travels along the railroad track, the method comprising:

propelling the detector carriage along the railroad track;

generating periodic synchronization pulses as a function of distance from a fixed reference point on the track, each synchronization pulse being assigned a synchronization pulse number;

obtaining for a plurality of rail locations induction sensor data using the magnetic induction sensor unit and ultrasonic sensor data from the ultrasonic sensor unit;

receiving the induction sensor data at the data processing system;

creating induction data objects from the induction sensor data, each induction data object including the synchronization pulse number associated with a sequentially first rail location where the induction sensor data for the induction data object was obtained;

receiving the ultrasonic sensor data at the data processing system;

creating ultrasonic data objects from the ultrasonic sensor data, each ultrasonic data object including the synchronization pulse number associated with a sequentially first rail location where the ultrasonic sensor data for the ultrasonic data object was obtained;

identifying suspected rail defects by applying defect detection rules to induction and ultrasonic data objects.

25. A method according to claim 24 wherein the step of receiving the induction sensor data at the data processing system includes receiving raw induction sensor unit signals at an induction data acquisition card and the step of creating induction data objects includes:

digitizing the raw induction sensor unit signals to produce digitized induction data;

filtering the digitized induction data to produce filtered induction data;

sampling the filtered induction data to form induction data sets, each induction data set including induction data from the one of the plurality of locations;

adding to each induction data set the pulse synchronization number associated with the location from which the induction data in the data set was obtained;

scaling the induction data of each data set for speed;

identifying groups of spatially sequential induction data sets meeting predetermined induction data object creation criteria; and building induction data objects from said data sets meeting predetermined induction data creation criteria.

26. A method according to claim 25 wherein the step of identifying groups of spatially sequential induction data sets meeting predetermined induction data object creation criteria includes applying an envelope detection algorithm to the induction data sets.

27. A method according to claim 25 wherein the predetermined induction data object creation criteria includes a minimum object length criterion.

28. A method according to claim 24 wherein the step of receiving the ultrasonic data at the data processing system includes receiving raw ultrasonic sensor unit signals at an ultrasonic data receiver card and the step of creating ultrasonic data objects includes:

amplifying the raw ultrasonic sensor unit signals to produce amplified ultrasonic signals;

digitizing the amplified ultrasonic signals to produce digitized ultrasonic data;

sampling the digitized ultrasonic data to form ultrasonic data sets, each ultrasonic data set including ultrasonic data from one of the plurality of locations;

determining for each ultrasonic data set whether the ultrasonic data set includes ultrasonic amplitude data exceeding a predetermined ultrasonic amplitude threshold;

adding to each ultrasonic data set having ultrasonic amplitude data exceeding the predetermined ultrasonic amplitude threshold the pulse synchronization number associated with the location from which the ultrasonic data in the data set was obtained;

identifying groups of spatially sequential ultrasonic data sets meeting predetermined ultrasonic data object creation criteria; and building ultrasonic data objects from said data sets meeting predetermined induction data creation criteria.

29. A method according to claim 28 wherein the predetermined ultrasonic data object creation criteria includes a minimum object length criterion.

* * * * *